US012623819B2

(12) United States Patent
Hession et al.

(10) Patent No.: US 12,623,819 B2
(45) **Date of Patent: *May 12, 2026**

(54) CHILD-RESISTANT LID FOR A CONTAINER

(71) Applicant: Altria Client Services LLC, Richmond, VA (US)

(72) Inventors: Christopher J. Hession, Mechanicsville, VA (US); Andrew T Peeler, Richmond, VA (US); William J. Bogdziewicz, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 130 days.

This patent is subject to a terminal disclaimer.

(21) Appl. No.: 18/593,246

(22) Filed: Mar. 1, 2024

(65) Prior Publication Data

US 2024/0199289 A1 Jun. 20, 2024

Related U.S. Application Data

(63) Continuation of application No. 17/964,620, filed on Oct. 12, 2022, now Pat. No. 11,975,898.

(51) Int. Cl.
*B65D 50/04* (2006.01)
*B65D 51/18* (2006.01)

(52) U.S. Cl.
CPC ..... *B65D 50/045* (2013.01); *B65D 51/18* (2013.01); *B65D 2251/0021* (2013.01); *B65D 2251/0081* (2013.01)

(58) Field of Classification Search
CPC ..... B65D 50/045; B65D 51/18; B65D 2251/0021; B65D 2251/0081; B65D 2543/00925; B65D 43/169
See application file for complete search history.

(56) References Cited

U.S. PATENT DOCUMENTS 3,603,470 A 9/1971 Armour et al.
3,850,326 A 11/1974 Ryles
(Continued)

FOREIGN PATENT DOCUMENTS

EP 2371729 A1 10/2011
EP 3188977 A1 7/2017

OTHER PUBLICATIONS

International Preliminary Report on Patentability issued Apr. 15, 2025 in International Application No. PCT/US2023/076215.
(Continued)

*Primary Examiner* — James N Smalley

(74) *Attorney, Agent, or Firm* — Harness, Dickey & Pierce, P.L.C.

(57) ABSTRACT

At least one example embodiment relates to a lid for a container including a base defining an opening and a top configured to engage a portion of the base. The base includes a support wall, a first sidewall, and a second sidewall. The first sidewall and the second sidewall extend from respective ends of the support wall such that the support wall, the first sidewall, and the second sidewall define a gap configured to receive at least a portion of the container. The top includes a cover, a hinge coupled between the cover and the base, and a peripheral wall extending from an interior portion of the cover. The cover is moveable between an open position providing access to the opening and a closed position sealing the opening.

20 Claims, 11 Drawing Sheets

(56) References Cited

U.S. PATENT DOCUMENTS

| | | | | |
|---|---|---|---|---|
| 4,385,706 | A | 5/1983 | Freeman | |
| 4,444,326 | A | 4/1984 | Musel | |
| 4,513,888 | A * | 4/1985 | Curry | B65D 47/0819 222/546 |
| 4,629,081 | A | 12/1986 | McLaren | |
| 4,702,389 | A | 10/1987 | Bozinovich et al. | |
| 4,782,964 | A | 11/1988 | Poore et al. | |
| 5,657,894 | A * | 8/1997 | Bowen | B65D 43/169 220/837 |
| 6,772,904 | B1 | 8/2004 | Gilliam et al. | |
| 9,205,959 | B2 | 12/2015 | Welk et al. | |
| 10,207,843 | B2 | 2/2019 | Choi | |
| 10,618,707 | B2 | 4/2020 | Straughan | |
| 2009/0014450 | A1 | 1/2009 | Bjorkholm | |
| 2010/0012534 | A1 | 1/2010 | Hoffman | |
| 2012/0205377 | A1 | 8/2012 | Adler et al. | |
| 2015/0344196 | A1 | 12/2015 | Groubert et al. | |
| 2020/0031539 | A1 | 1/2020 | Faulkner | |
| 2020/0277110 | A1 | 9/2020 | Patel et al. | |
| 2021/0039843 | A1 | 2/2021 | Kouba et al. | |
| 2022/0106091 | A1 | 4/2022 | Tidwell | |

OTHER PUBLICATIONS

International Search Report and Written Opinion issued Feb. 9, 2024 in International Application No. PCT/US2023/076215.

Non-Final Office Action issued Aug. 15, 2023 in U.S. Appl. No. 17/964,620.

Notice of Allowance issued Nov. 28, 2023 in U.S. Appl. No. 17/964,620.

* cited by examiner

CHILD-RESISTANT LID FOR A CONTAINER

CROSS-REFERENCE TO RELATED APPLICATIONS

This application is a Continuation of, and claims priority under 35 U.S.C. § 120 to, U.S. application Ser. No. 17/964,620, filed on Oct. 12, 2022, the entire contents of which are incorporated herein by reference.

BACKGROUND

Field

The present disclosure relates to a child-resistant lid for a container.

SUMMARY

At least one example embodiment relates to a lid for a container.

In at least one example embodiment, the lid includes a base defining an opening and a top configured to engage a portion of the base. The base includes a support wall, a first sidewall, and a second sidewall. The first sidewall and the second sidewall extend from respective ends of the support wall such that the support wall, the first sidewall, and the second sidewall define a gap configured to receive at least a portion of the container. The top includes a cover, a hinge coupled between the cover and the base, and a peripheral wall extending from an interior portion of the cover. The cover is moveable between an open position providing access to the opening and a closed position sealing the opening.

In at least one example embodiment, the first sidewall and the second sidewall are perpendicular to the support wall.

In at least one example embodiment, a length of the first sidewall is greater than a length of the second sidewall.

In at least one example embodiment, the lid includes a first protrusion extending from an interior surface of the first sidewall.

In at least one example embodiment, the first protrusion is configured to engage the container.

In at least one example embodiment, the first protrusion is configured to engage a corresponding protrusion on an exterior surface of the container.

In at least one example embodiment, the base is configured to engage at least a portion of the container in a snap-fit.

In at least one example embodiment, the first protrusion comprises a plurality of protrusions extending from an interior surface of the first sidewall.

In at least one example embodiment, the lid includes a first protrusion extending from the peripheral wall of the cover.

In at least one example embodiment, the second sidewall defines a groove, and the first protrusion is configured to engage the groove and lock the top in the closed position.

In at least one example embodiment, the top is configured to move from the closed position to the open position by concurrently applying a force on opposing sides of the container.

In at least one example embodiment, the top is configured to move from the closed position to the open position by concurrently applying a force on opposing sides of the base.

In at least one example embodiment, the top is configured to move from the closed position to the open position by applying a force on a portion of the container opposite the hinge.

In at least one example embodiment, the top is configured to move from the closed position to the open position by applying a force on a portion of the base opposite the hinge.

At least one example embodiment relates to a method.

In at least one example embodiment, the method includes establishing a lid for a container having a base and a top and connecting the base of the lid to a top portion of the container. The base defines an opening to the container. The base includes a support wall, a first sidewall, and a second sidewall. The first sidewall and the second sidewall extend from respective ends of the support wall such that the support wall, the first sidewall, and the second sidewall define a gap configured to receive at least a portion of the container. The top includes a cover, a hinge coupled between the cover and the base such that the top is moveable between an open position and a closed position, and a peripheral wall extending from an interior portion of the cover.

In at least one example embodiment, the connecting the base of the lid to a top portion of the container includes engaging a first protrusion extending from an interior surface of the first sidewall with a corresponding protrusion on an exterior surface of the container.

In at least one example embodiment, the method includes engaging a first protrusion on the peripheral wall with a groove defined by the second sidewall in the closed position.

In at least one example embodiment, the method includes applying a force to opposing sides of the base and the container to move the top from the closed position to the open position providing access to the opening.

In at least one example embodiment, the applying the force comprises disengaging a first protrusion on the peripheral wall from a groove of the second sidewall.

In at least one example embodiment, the method includes applying a force on a front portion of the base and the container opposite the hinge to move the top from the closed position to the open position providing access to the opening.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION OF EXAMPLE EMBODIMENT

Figure 1:
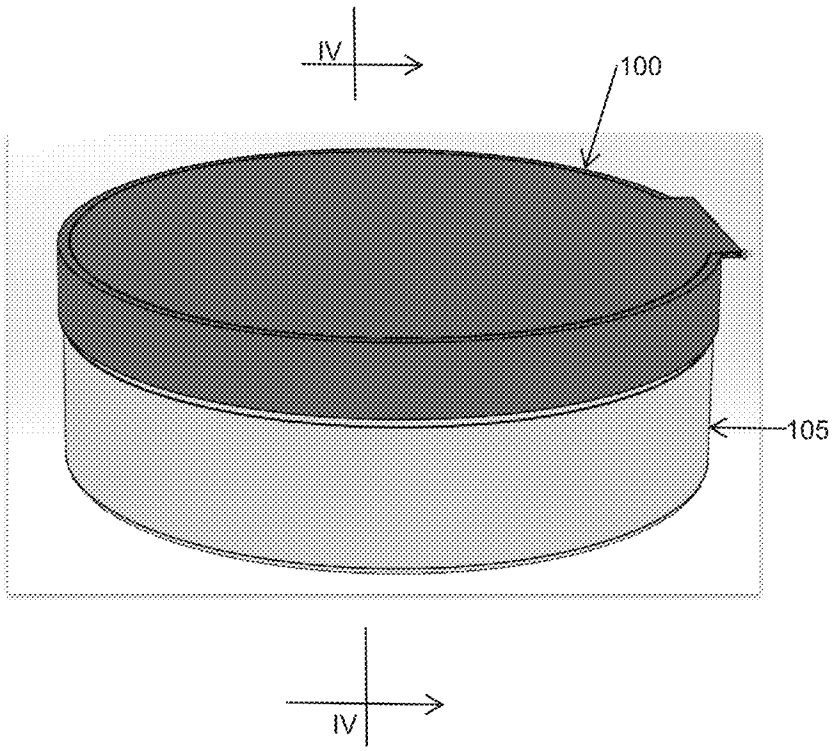
FIG. 1 is a front perspective view of a container and lid according to at least one example embodiment.

Some detailed example embodiments are disclosed herein. However, specific structural and functional details disclosed herein are merely representative for purposes of describing some example embodiments. Example embodiments may, however, be embodied in many alternate forms and should not be construed as limited to only example embodiments set forth herein.

Accordingly, while example embodiments are capable of various modifications and alternative forms, example embodiments thereof are shown by way of example in the drawings and will herein be described in detail. It should be understood, however, that there is no intent to limit an example embodiment to the particular forms disclosed, but to the contrary, example embodiments are to cover all modifications, equivalents, and alternatives falling within the scope of an example embodiment. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, regions, layers and/or sections, these elements, regions, layers, and/or sections should not be limited by these terms. These terms are only used to distinguish one element, region, layer, or section from another region, layer, or section. Thus, a first element, region, layer, or section discussed below could be termed a second element, region, layer, or section without departing from the teachings of example embodiment.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiment only and is not intended to be limiting of example embodiment. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, and/or elements, but do not preclude the presence or addition of one or more other features, integers, steps, operations, elements and/or groups thereof.

Example embodiments are described herein with reference to cross-sectional illustrations that are schematic illustrations of example embodiment. As such, variations from the shapes of the illustrations are to be expected. Thus, example embodiment should not be construed as limited to the shapes of regions illustrated herein but are to include deviations and variations in shapes.

When the words "about" and "substantially" are used in this specification in connection with a numerical value, it is intended that the associated numerical value include a tolerance of ±10% around the stated numerical value, unless otherwise explicitly defined. Moreover, when the terms "generally" or "substantially" are used in connection with geometric shapes, it is intended that precision of the geometric shape is not required but that latitude for the shape is within the scope of the disclosure. Furthermore, regardless of whether numerical values or shapes are modified as "about," "generally," or "substantially," it will be understood that these values and shapes should be construed as including a manufacturing or operational tolerance (e.g., ±10%) around the stated numerical values or shapes.

Unless otherwise defined, all terms (including technical and scientific terms) used herein have the same meaning as commonly understood by one of ordinary skill in the art to which example embodiment belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

FIG. 1 is a front perspective view of a container and lid according to at least one example embodiment.

A lid 100 and a container 105 may be used with smokeless tobacco products. The lid 100 and the container 105 may have a circular or a cylindrical shape. The lid 100 may be coupled to the container 105, as will be discussed in relation to FIGS. 2-4, below. In at least one example embodiment, the lid 100 includes a closed position (shown in FIG. 1) and an open position (shown in FIG. 2).

Figure 2:
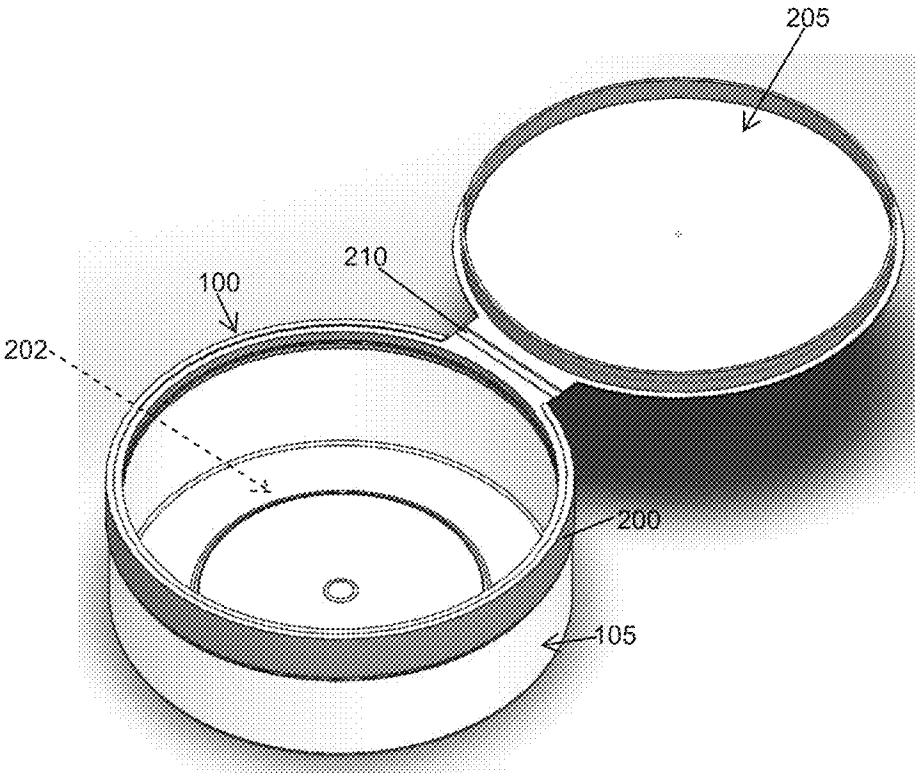
FIG. 2 is a top perspective view of the container and lid of FIG. 1 in an open position according to at least one example embodiment.
Figure 3:
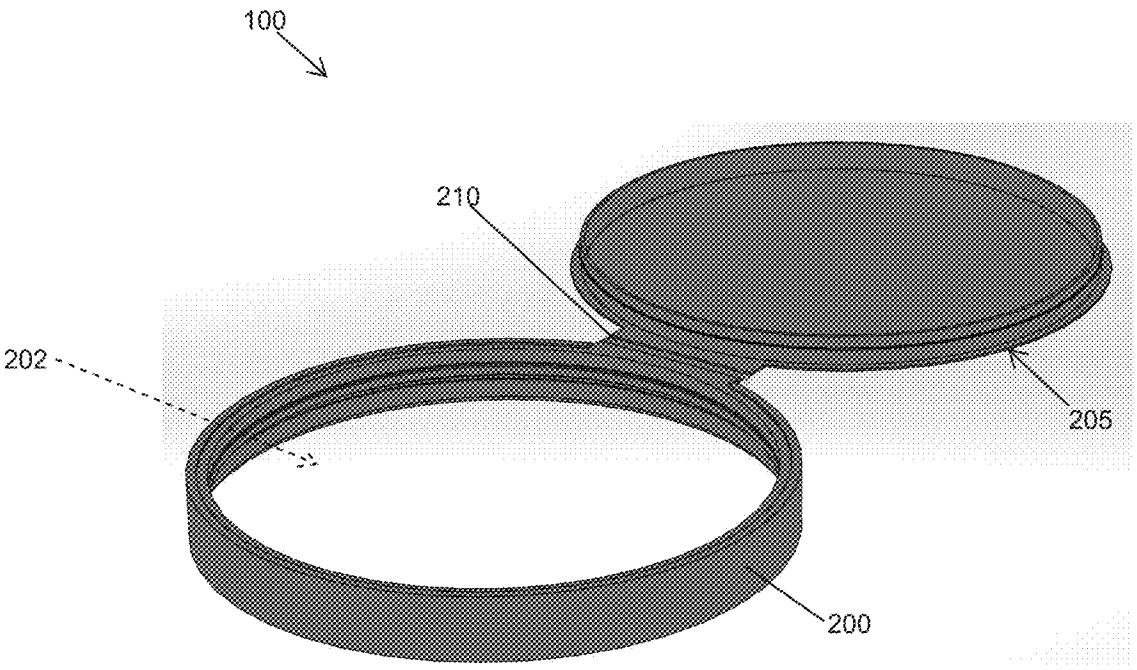
FIG. 3 is a front perspective view of the lid of FIG. 2 according to at least one example embodiment.

FIG. 2 is a top perspective view of the container 105 and the lid 100 of FIG. 1 in an open position according to at least one example embodiment. FIG. 3 is a front perspective view of the lid of FIG. 2 according to at least one example embodiment.

In at least one example embodiment, the lid 100 includes a base 200, a top 205, and a hinge 210. In at least one example embodiment, the lid 100 and the base 200 each have a circular shape. The base 200 may be configured to be coupled to the container 105 and secure the lid 100 to the container 105. For example, the base 200 may be configured to engage the container 105 in a snap-fit, as will be discussed in relation to FIG. 4. In other example embodiments, the base 200 may be configured to engage the container 105 by screwing the base 200 onto the container 105.

The base 200 may also define an opening 202. The opening 202 may be circular and provide access to an interior portion of the container when the lid 100 is in the open position. In at least one example embodiment, the hinge 210 may be coupled between the base 200 and the top 205 such that the top 205 is moveable between the open position and the closed position. For example, the hinge 210 may be coupled to a cover portion of the top 205. In at least one example embodiment, the hinge 210 may be welded to a portion of the base 200 and the top 205.

Figure 4:
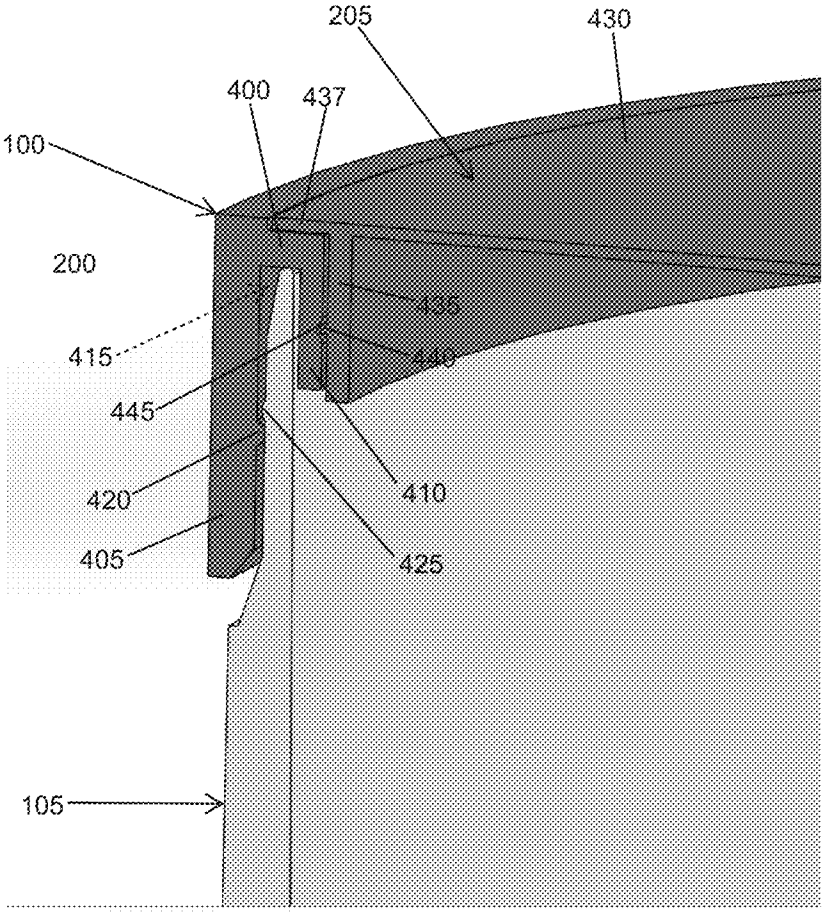
FIG. 4 is a detailed sectional view of the container and lid of FIG. 1 along line IV-IV of FIG. 1 according to at least one example embodiment.

FIG. 4 is a detailed sectional view of the container and lid of FIG. 1 along line IV-IV of FIG. 1 according to at least one example embodiment.

As shown in FIG. 4, in at least one example embodiment, the base 200 includes a support wall 400, a first sidewall 405, and a second sidewall 410. The first sidewall 405 and the second sidewall 410 may extend from respective ends of the support wall 400. In at least one example embodiment, the first sidewall 405 and the second sidewall 410 may be perpendicular to the support wall 400. The first sidewall 405 and the second sidewall 410 may also define a gap 415. In at least one example embodiment, the first sidewall 405, the second sidewall 410, and the gap 415 are cylindrical. The gap 415 may be configured to receive at least a portion of the container 105. For example, the gap 415 may be configured to receive a top end of the container 105. In at least one example embodiment, an end of the first sidewall 405 may taper from an interior surface toward an exterior surface of the first sidewall 405. In at least one other example embodiment, a length of the first sidewall 405 may be greater than a length of the second sidewall 410.

In at least one example embodiment, a first protrusion 420 may extend inward from an interior surface of the first sidewall 405. For example, when the first sidewall 405 is cylindrical, the first protrusion 420 may extend radially inward from the interior surface of the first sidewall 405 toward the second sidewall 410 and/or an exterior surface of the container 105. In at least one example embodiment, the first protrusion 420 is continuous about the first sidewall 405. In at least one other example embodiment, the first protrusion 420 may be discontinuous about the first sidewall. For example, the first protrusion 420 may comprise two or more protrusions. The first protrusion 420 may also be configured to engage at least a portion of the container 105, such as in a snap-fit. For example, the first protrusion 420 may be configured to engage one or more corresponding protrusions 425 on at least a portion of the exterior surface of the container 105. The first protrusion 420 may comprise a trapezoidal, circular, ovular, rectangular, or polygonal shape.

In at least one example embodiment, the top 205 may include a cover portion, such as a cover 430, and a peripheral wall 435. In at least one example embodiment, the cover 430 is substantially flat or planar. The peripheral wall 435 extends from an interior portion of the cover 430. For example, the peripheral wall 434 may be cylindrical and annularly extend about a circumference of the cover 430. In at least one example embodiment, the peripheral wall 435 may be offset from an edge of the cover 430, as shown in FIG. 4. For example, the peripheral wall 434 may be offset from the edge of the cover 430 such that the peripheral wall 435 is parallel with the second sidewall 410 and an overhang 437 of the cover 430 is configured to be positioned over at least a portion of the support wall 400 when the lid 100 is in the closed position. In such embodiments, the cover 430 may be flush with a top surface of the base 200. In at least one other example embodiment, the peripheral wall 435 may extend from the edge of the cover 430.

In at least one example embodiment, when the peripheral wall 435 is cylindrical, a bead, such as a second protrusion 440, may extend radially outward from at least a portion of an exterior surface of the peripheral wall 435. In some example embodiments, the second sidewall 410 may define a recess or a groove 445 configured to receive at least a portion of the second protrusion 440. The second protrusion may comprise a trapezoidal, circular, ovular, rectangular, or polygonal shape. The second protrusion 440 may be configured to engage the groove 445 and lock the top 205 in the closed position. For example, the top 205 may be coupled to the base 200 by a snap-fit.

In at least one example embodiment, the top 205 may be configured to move from the closed position to the open position by concurrently applying a force on opposing sides of the container 105. In at least one example embodiment, the top 205 may be configured to move from the closed position to the open position by concurrently applying a force on opposing sides of the base 200 of the lid 100. In at least one other example embodiment, the top 205 may be configured to move from the closed position to the open position by applying a force on a portion of the container 105 and/or the base 200 opposite the hinge 210.

In at least one example embodiment, the force applied to opposing sides of the container 105, to opposing sides of the base 200, or to a portion of the container 105 and/or the base 200 opposite the hinge 210 may cause the top 205 to move from the closed position to a partially open position or a fully open position. For example, if a large enough force is applied, the second protrusion 440 may disengage with the groove 445 such that that the top 205 opens to the fully open position. In the fully open position, the top 205 may no longer be in contact with the base 200 and the opening 202 may be accessed. If a smaller force is applied, the second protrusion 440 may disengage from the groove 445 while the top 205 is still at least partially in contact with the base 200. In such embodiments, a user may then push the top 205 upward. For example, an edge of the top 205 opposite the hinge 210 may be pushed upward such that the top 205 is in the fully open position.

Figure 5:
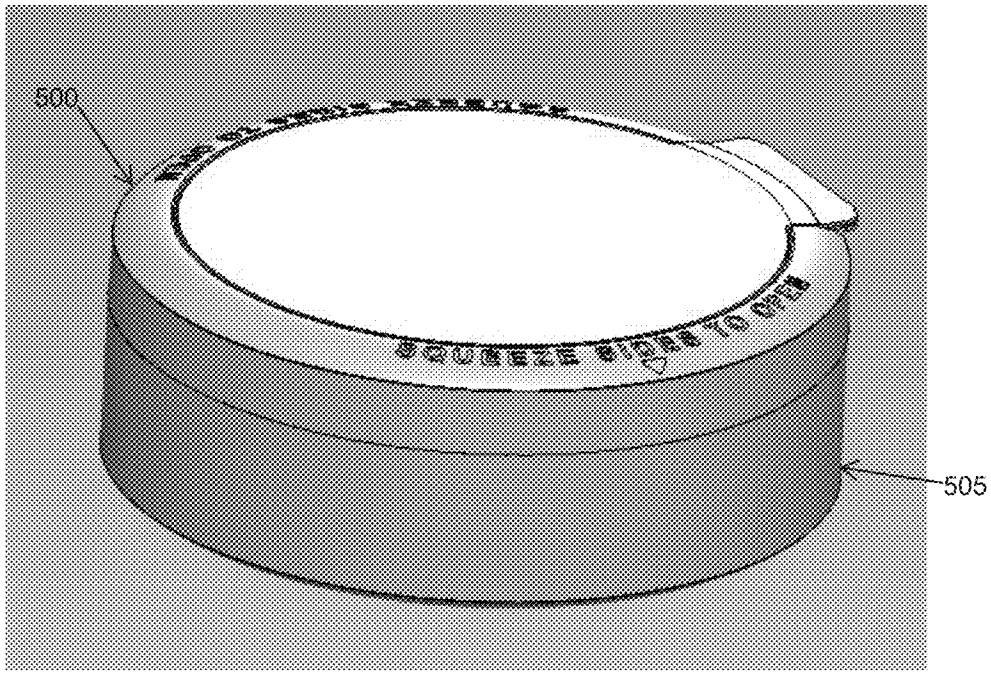
FIG. 5 is a front perspective view of a container and lid according to at least one example embodiment.

FIG. 5 is a front perspective view of a container and lid according to at least one example embodiment.

A lid 500 and a container 505 may be used with smokeless tobacco products. The lid 500 and the container 505 may have a circular or a cylindrical shape. The lid 500 may be coupled to the container 505, as will be discussed in relation to FIGS. 5-10, below. In at least one example embodiments, the lid 500 includes a closed position (shown in FIG. 1) and an open position (shown in FIG. 6).

Figure 6:
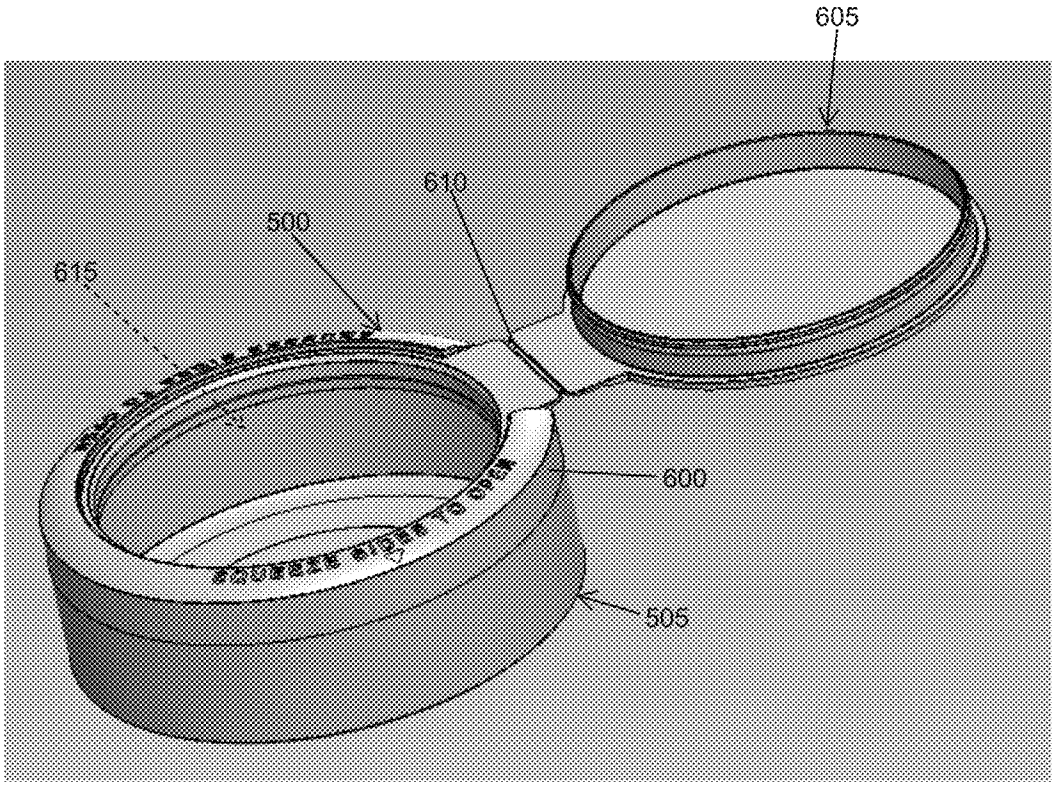
FIG. 6 is a front perspective view of the container and lid of FIG. 5 in an open position according to at least one example embodiment.
Figure 7:
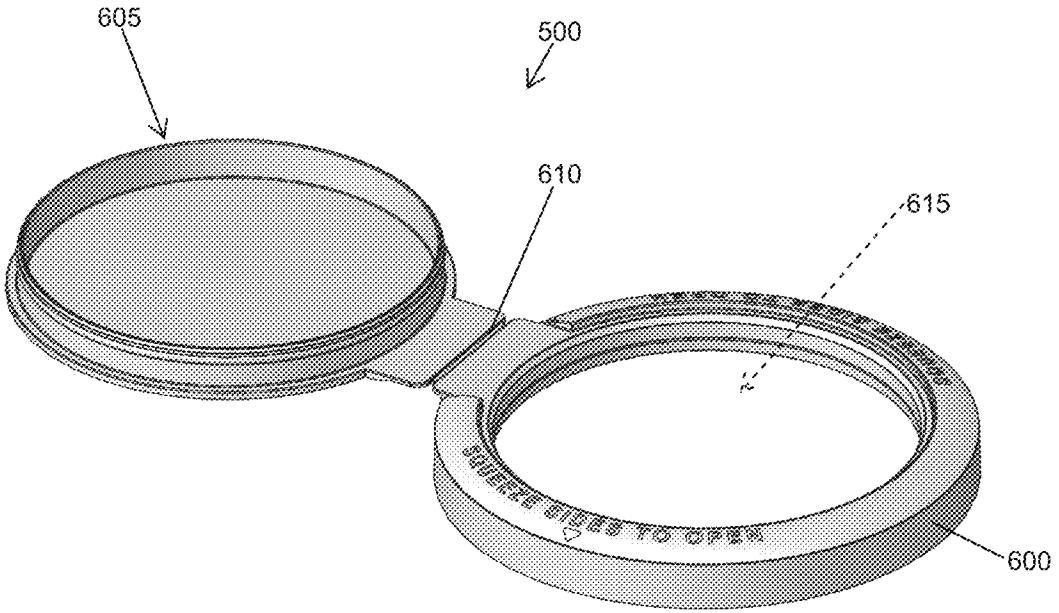
FIG. 7 is a top front perspective view of the lid of FIG. 6 according to at least one example embodiment.

FIG. 6 is a front perspective view of the container and lid of FIG. 5 in an open position according to at least one example embodiment. FIG. 7 is a top front perspective view of the lid of FIG. 6 according to at least one example embodiment.

In at least one example embodiments, the lid 500 includes a base 600, a top 605, and a hinge 610. The base 600 and the top 605 may have a circular shape. The base 600 may be configured to be coupled to the container 505 and secure the lid 500 to the container 505. For example, the base 600 may be configured to engage the container 505 in a snap-fit, as will be discussed in relation to FIGS. 8-9. In other example embodiments, the base 600 may be configured to engage the container 505 by screwing or threading the base 600 onto the container 505.

The base 600 may also define an opening 615. The opening 615 may be circular and may provide access to an interior portion of the container 505 when the lid 500 is in the open position. In at least one example embodiment, the hinge 610 may be coupled between the base 600 and the top 605 such that the top 605 is moveable between the open position and the closed position. For example, the hinge 610 may be coupled to a cover portion of the top 605. In at least one example embodiment, the hinge 610 may be welded to a portion of the base 600 and the top 605.

Figure 8:
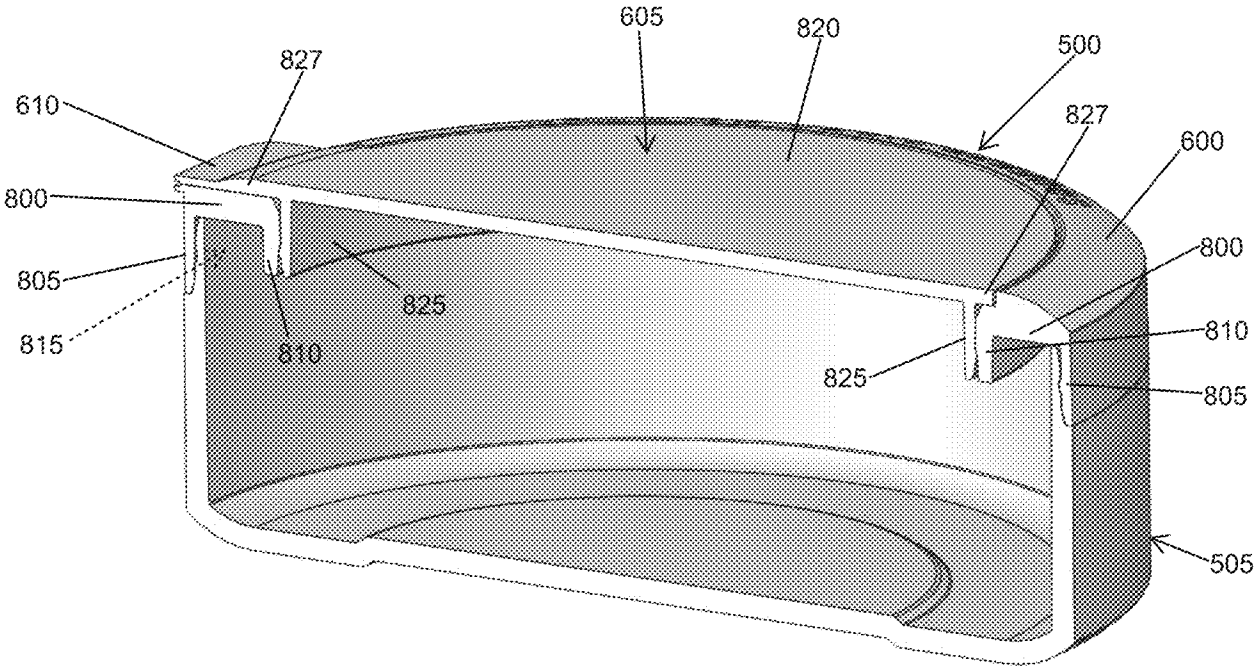
FIG. 8 is a schematic sectional view of the container and the lid of FIG. 5. along line VIII-VIII of FIG. 5 according to at least one example embodiment.

FIG. 8 is a schematic sectional view of the container and the lid of FIG. 5. along line VIII-VIII of FIG. 5 according to at least one example embodiment.

As shown in FIG. 8, in at least one example embodiment, the base 600 includes a support wall 800, a first sidewall 805, and a second sidewall 810. The first sidewall 805 and the second sidewall 810 may extend from respective ends of the support wall 800. In at least one example embodiment, a top surface of the support wall 800 may be rounded or curved. In other example embodiments, the top surface of the support wall 800 may be substantially flat or planar.

In at least one example embodiment, the first sidewall 805 and the second sidewall 810 may be perpendicular to the support wall 800. The first sidewall 805 and the second sidewall 810 may also define a gap 815. In at least one example embodiment, the first sidewall 805, the second sidewall 810, and the gap 815 are cylindrical. The gap 815 may be configured to receive at least a portion of the container 505. For example, the gap 815 may be configured to receive a top end of the container 505. In at least one example embodiment, a width of the first sidewall 805 may decrease from a top portion to a bottom portion of the first sidewall. In at least one other example embodiment, a length of the first sidewall 805 may be greater than a length of the second sidewall 810.

Figure 9:
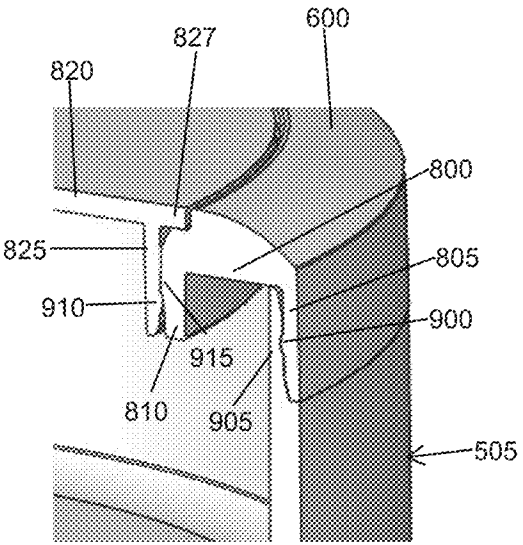
FIG. 9 is a detailed sectional view of the container and the lid of FIG. 8 according to at least one example embodiment.

In at least one example embodiment, the top 605 may include a cover portion, such as a cover 820, and a peripheral wall 825. In at least one example embodiment, the cover 820 is substantially flat or planar. In other example embodiments, edges of the cover 820 may be curved. The peripheral wall 825 extends from an interior portion of the cover 820. For example, the peripheral wall 825 may be cylindrical and annularly extend about a circumference of the cover 820. In at least one example embodiment, the peripheral wall 825 may be offset from an edge of the cover 820, as shown in FIGS. 8-9. For example, the peripheral wall 825 may be offset from the edge of the cover 820 such that the peripheral wall 825 is parallel with the second sidewall 810 and an overhang 827 of the cover 820 is configured to be positioned over at least a portion of the second sidewall 810 and/or the support wall 800 of the base 600. The cover 820 of the top 605 may be configured to be flush with a top surface of the base 600 when the top 605 is in the closed position (as shown in FIGS. 5, 8, and 9). In at least one other example embodiment, the peripheral wall 825 may extend from the edge of the cover 820.

FIG. 9 is a detailed sectional view of the container and the lid of FIG. 8 according to at least one example embodiment.

In at least one example embodiment, a first protrusion 900 may extend inward from at least a portion of an interior surface of the first sidewall 805. For example, when the first sidewall 805 is cylindrical, the first protrusion 900 may extend radially inward from the interior surface of the first sidewall 805 toward the second sidewall 810 and/or an exterior surface of the container 505. The first protrusion 900 may be continuous about the interior surface of the first sidewall 805 in some embodiments. The first protrusion 900 may be configured to engage at least a portion of the container 505, such as by a snap-fit. For example, the first protrusion 900 may be configured to engage one or more corresponding protrusions or container grooves 905 on an exterior surface of the container 505. The first protrusion 900 may comprise a trapezoidal, circular, ovular, rectangular, or polygonal shape.

In at least one example embodiment, when the peripheral wall 825 is cylindrical, a bead, such as a second protrusion 910, may extend radially outward from at least a portion of an exterior surface of the peripheral wall 825 of the top 605. In some example embodiments, the second sidewall 810 may include a third protrusion 915 extending from an interior-facing surface of the second sidewall 810. For example, when the second sidewall 810 is cylindrical, the third protrusion 915 may extend radially outward from the interior-facing surface of at least a portion of the second sidewall 810. The third protrusion 915 may comprise a trapezoidal, circular, ovular, rectangular, or polygonal shape. The third protrusion 915 may be configured to engage the second protrusion 910 and lock the top 605 in the closed position. For example, the top 605 may be coupled to the base 600 by a snap-fit. In other example embodiments, the third protrusion 915 may be a recess or a groove formed on the interior-facing surface of the second sidewall 810 and configured to receive the third protrusion 915.

In at least one example embodiment, the top 605 may be configured to move from the closed position to the open position by concurrently applying a force on opposing sides of the container 505. In at least one example embodiment, the top 605 may be configured to move from the closed position to the open position by concurrently applying a force on opposing sides of the base 600 of the lid 500. In at least one other example embodiment, the top 605 may be configured to move from the closed position to the open position by applying a force on a portion of the container 505 and/or the base 600 opposite the hinge 610.

In at least one example embodiment, the force applied to opposing sides of the container 505, to opposing sides of the base 600, or to a portion of the container 505 and/or the base 600 opposite the hinge 610 may cause the top 605 to move from the closed position to a partially open position or a fully open position. For example, if a large enough force is applied, the second protrusion 910 may disengage with the third protrusion 915 such that that the top 605 opens to the fully open position. In the fully open position, the top 605 may no longer be in contact with the base 600 and the opening 615 may be accessed. If a smaller force is applied, the second protrusion 910 may disengage from the third protrusion 915 while the top 605 is still at least partially in contact with the base 600. In such embodiments, a user may then push the top 605 upward. For example, an edge of the top 605 opposite the hinge 610 may be pushed upward such that the top 605 is in the fully open position.

Figure 10:
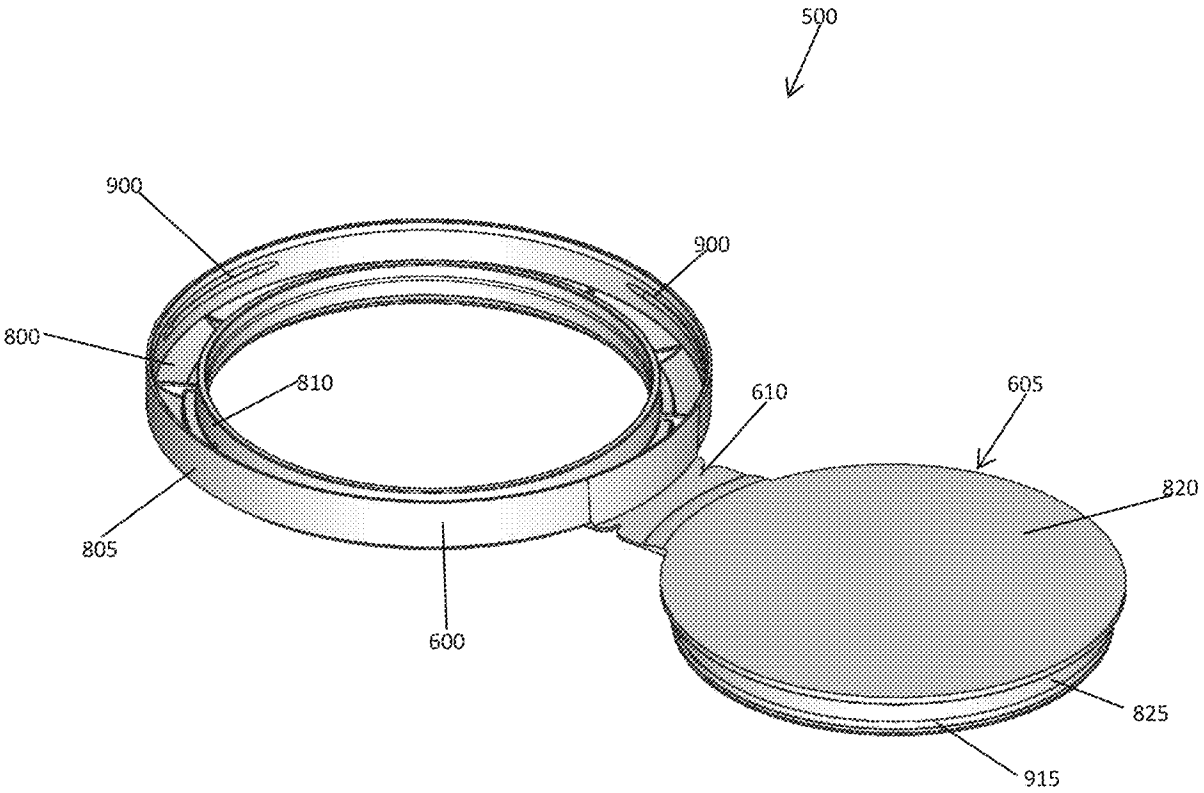
FIG. 10 is a bottom perspective view of the lid of FIG. 7 according to at least one example embodiment.

FIG. 10 is a bottom perspective view of the lid of FIG. 7 according to at least one example embodiment.

As shown in FIG. 10, in at least one example embodiment, the first protrusion 900 may be discontinuous. For example, when the first sidewall 805 is cylindrical, the first protrusion 900 may comprise a plurality of first protrusions 900 extending radially inward from the interior surface of the first sidewall 805. In some example embodiments, the plurality of first protrusions 900 may be spaced circumferentially about the interior surface of the first sidewall 805. For example, three of the first protrusions 900 may be equally spaced about the interior surface of the first sidewall 805.

Figure 11:
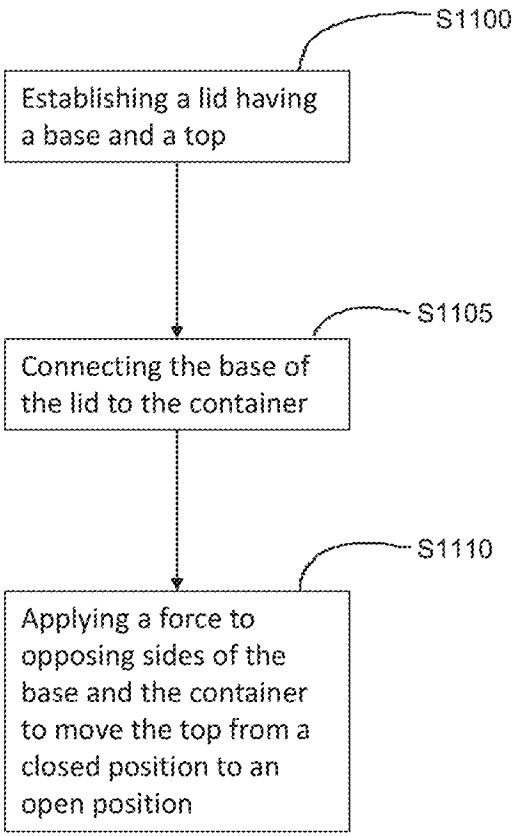
FIG. 11 is a flowchart depicting a method of using a lid for a container according to at least one example embodiment.

FIG. 11 is a flowchart depicting a method of using a lid for a container according to at least one example embodiment.

As shown in FIG. 11, in at least one example embodiments, the method generally includes establishing a lid having a base and a top at S1100, connecting the base of the lid to a container at S1105, and applying a force to opposing sides of the base and/or the container to move the top from a closed position to an open position at S1110. Each of the steps is describes in greater detail below.

At S1100, in at least one example embodiment, the method includes establishing a lid having a base and a top. As described above in relation to FIGS. 1-4, the lid 100 may be established and include the base 200 and the top 205. In at least one example embodiments, the base 200 includes the support wall 400, the first sidewall 405, and the second sidewall 410. The first sidewall 405 and the second sidewall 410 may extend from respective ends of the support wall 400 such that the support wall 400, the first sidewall 405, and the second sidewall 410 define a gap 415 configured to receive at least a portion of the container 105. In at least one example embodiment, the top 205 includes the cover 430, the hinge 210 coupled between the cover 430 and the base 200 such that the top 205 is moveable between the closed position and the open position, and the peripheral wall 435 extending from an interior portion of the cover 430. In at least one other example embodiment, as described above in relation to FIGS. 5-10, the lid 500 including the base 600 and the top 605 may be established at S1100.

At S1105, in at least one example embodiment, the method includes connecting the base 200 of the lid 100 to a top portion of the container 105. The base 200 may define an opening 202 to the container 105. In at least one example embodiments, connecting the base 200 of the lid 100 to the top portion of the container 105 includes engaging the first protrusion 420 extending from the interior surface of the first sidewall 405 with the corresponding protrusion 425 on the exterior surface of the container 105. In some example embodiments, the method further includes engaging the second protrusion 440 on the peripheral wall 435 of the top 205 with the groove 445 defined by the second sidewall 410 in the closed position.

In at least one other example embodiment, the method includes connecting the base 600 of the lid 500 to a top portion of the container 505 at S1105. The base 600 may define an opening 615 to the container 505. In at least one example embodiments, connecting the base 600 of the lid 500 to the top portion of the container 505 includes engaging the first protrusion 900 extending from the interior surface of the first sidewall 805 with the container groove 905 on the exterior surface of the container 505. In some example embodiments, the method further includes engaging the second protrusion 910 on the peripheral wall 825 of the top 605 with the third protrusion 915 extending from the second sidewall 810 in the closed position.

At S1110, in at least one example embodiment, the method includes applying a force to opposing sides of the base 200 and/or the container 105 to move the top 205 from the closed position to the open position providing access to the opening 202. In at least one example embodiment, applying the force comprises disengaging the second protrusion 440 of the peripheral wall 435 from the groove 445 of the second sidewall 410. In at least one example embodiment, applying the force on a front portion of the base 200 and/or the container 105 opposite the hinge 210 may move the top 205 from the closed position to the open position providing access to the opening 202.

In at least one other example embodiment, the method includes applying a force to opposing sides of the base 600 and/or the container 505 to move the top 605 from the closed position to the open position providing access to the opening 615 at S1110. In at least one example embodiment, applying the force comprises disengaging the second protrusion 910 of the peripheral wall 825 from the third protrusion 915 of the second sidewall 810. In at least one example embodiment, applying the force on a front portion of the base 600 and/or the container 505 opposite the hinge 610 may move the top 605 from the closed position to the open position providing access to the opening 615.

We claim:

1. A lid for a container, comprising:

a base defining an opening, the base including,
- a support wall,
- a first sidewall defining an annular outer face of the base, and
- a second sidewall having a groove therein, wherein the first sidewall and the second sidewall each extend from respective ends of the support wall; and a top configured to engage a portion of the base, the top including,
- a cover,
- a hinge coupled between the cover and the base such that the cover is moveable from a closed position sealing the opening to an open position providing access to the opening, and
- a peripheral wall extending from an interior portion of the cover, the peripheral wall having a top protrusion extending outwards from the peripheral wall of the cover, the top protrusion configured to engage with the groove in the second sidewall of the base to lock the cover in the closed position, wherein the top protrusion on the peripheral wall is configured to disengage from the groove of the second sidewall to unlock the cover by concurrently applying a force on opposing sides of the annular outer face of the base.

2. The lid of claim 1, wherein the first sidewall and the second sidewall are perpendicular to the support wall.

3. The lid of claim 1, wherein a length of the first sidewall is greater than a length of the second sidewall.

4. The lid of claim 1, further comprising:

a base protrusion extending from an interior surface of the first sidewall.

5. The lid of claim 4, wherein the first base protrusion is configured to engage the container.

6. The lid of claim 5, wherein the first protrusion is configured to engage a corresponding container protrusion on an exterior surface of the container.

7. The lid of claim 1, wherein the base is configured to engage at least a portion of the container in a snap-fit.

8. The lid of claim 4, wherein the base protrusion comprises a plurality of base protrusions extending from the interior surface of the first sidewall.

9. The lid of claim 1, wherein the top is configured to move from the closed position to the open position by concurrently applying a force on opposing sides of the container.

10. The lid of claim 1, wherein an edge of the cover is flush with a top surface of the base when the lid is in the closed position, and the peripheral wall is offset from the edge of the cover such that the peripheral wall divides the cover into a central portion and an overhang portion; the overhang portion of the cover configured to rest on at least a portion of the support wall such that the edge of the cover is flush with the top surface of the base when the lid is in the closed position.

11. A method of using a lid for a container, comprising:

establishing the lid having a base and a top, the base defining an opening of the container, the base including, a support wall, a first sidewall defining an annular outer face of the base, and a second sidewall having a groove therein, wherein the first sidewall and the second sidewall each extend from respective ends of the support wall, the top including, a cover, a hinge coupled between the cover and the base such that the top is moveable from a closed position sealing the opening of the container to an open position providing access to the opening, and a peripheral wall extending from an interior portion of the cover, the peripheral wall having a top protrusion extending outwards from the peripheral wall of the cover;

connecting the base of the lid to a top portion of the container;

engaging the top protrusion on the peripheral wall of the top with the groove in the second sidewall of the base to lock the cover in the closed position; and disengaging the top protrusion on the peripheral wall from the groove of the second sidewall to unlock the cover by concurrently applying a force on opposing sides of the annular outer face of the base.

12. The method of claim 11, wherein the connecting the base of the lid to the top portion of the container comprises:

engaging a base protrusion extending from an interior surface of the first sidewall with a corresponding container protrusion on an exterior surface of the container.

13. The lid of claim 1, wherein the annular outer face of the base defined by the first side wall is continuously annular.

14. The lid of claim 1, wherein the first sidewall, the second sidewall, and the support wall define a gap configured to receive at least a portion of the container.

15. The lid of claim 1, wherein an end of the first sidewall tapers from an interior surface towards an exterior surface of the first sidewall.

16. The lid of claim 4, wherein the base protrusion has a trapezoidal, circular, ovular, rectangular, or polygonal shape.

17. The method of claim 11, wherein the annular outer face of the base defined by the first side wall is continuously annular.

18. The method of claim 11, wherein the first sidewall, the second sidewall, and the support wall define a gap configured to receive at least a portion of the container.

19. The method of claim 11, wherein an end of the first sidewall tapers from an interior surface towards an exterior surface of the first sidewall.

20. The method of claim 12, wherein the base protrusion has a trapezoidal, circular, ovular, rectangular, or polygonal shape.

* * * * *